US006605903B2

(12) United States Patent
Swallow

(10) Patent No.: US 6,605,903 B2
(45) Date of Patent: Aug. 12, 2003

(54) SELECTIVELY ACTIVATING DISPLAY COLUMN SECTIONS

(75) Inventor: Mary E. Swallow, Tempe, AZ (US)

(73) Assignee: Intel Corporation, Santa Clara, CA (US)

( * ) Notice: Subject to any disclaimer, the term of this patent is extended or adjusted under 35 U.S.C. 154(b) by 96 days.

(21) Appl. No.: 09/727,040

(22) Filed: Nov. 30, 2000

(65) Prior Publication Data

US 2002/0063533 A1 May 30, 2002

(51) Int. Cl.[7] ..... G09G 3/10

(52) U.S. Cl. ..... 315/169.3; 315/169.4; 345/55; 313/513; 445/3

(58) Field of Search ..... 315/58, 366, 169.1, 315/334, 169.3, 169.4; 313/510, 513, 519, 422; 345/36, 55, 33, 46; 445/3, 24

(56) References Cited

U.S. PATENT DOCUMENTS

| | | | | | |
|---|---|---|---|---|---|
| 4,676,761 | A | * | 6/1987 | Poujois | 445/3 |
| 4,958,149 | A | * | 9/1990 | Harvey | 345/33 |
| 5,151,632 | A | * | 9/1992 | Troxell | 315/169.1 |
| 5,559,528 | A | * | 9/1996 | Ravid et al. | 340/815.44 |
| 5,638,199 | A | * | 6/1997 | Tsubota et al. | 349/110 |
| 5,688,551 | A | * | 11/1997 | Littman et al. | 313/502 |
| 6,291,116 | B1 | * | 9/2001 | Wolk et al. | 313/604 |

* cited by examiner

*Primary Examiner*—Don Wong
*Assistant Examiner*—Ephrem Alemu
(74) *Attorney, Agent, or Firm*—Trop, Pruner & Hu, P.C.

(57) ABSTRACT

A light emitting display may include cathode columns with a folded arrangement so that each column includes two selectively activatable sections. Each column section may be selectively activated or deactivated depending on whether defects are associated with a given section.

4 Claims, 2 Drawing Sheets

SELECTIVELY ACTIVATING DISPLAY COLUMN SECTIONS

BACKGROUND

This invention relates generally to displays for processor-based systems and appliances.

Emissive displays include light emitting devices that emit light in response to a potential. In one embodiment, each pixel may be formed of an organic light emitting device. The organic light emitting device may emit light associated with a particular color in a color gamut. Alternatively, a filter may be used to produce a desired light color.

Polymer displays or organic light emitting displays use layers of light emitting polymers. Unlike liquid crystal devices, the polymer displays actually emit light. Light emission may be advantageous for many applications.

Generally, polymer displays use at least one semiconductor conjugated polymer sandwiched between a pair of contact layers. The contact layers produce an electric field which injects charge carriers into the polymer layer. When the charge carriers combine in the polymer layer, the charge carriers decay and emit radiation in the visible range.

One semiconductive conjugated polymer that may be used in polymer displays is poly(p-phenylenevinylene) (PPV) which emits green light. Another polymer that emits red-orange light is poly(methylethylhexyloxy-p-phenylenevinylene) (MEHPPV). Other polymers of this class are also capable of emitting blue light. In addition nitrile substituted conjugated polymers may be used in forming polymer displays.

Active matrix polymer displays may be formed from a substrate such as glass or metal foil covered with an array of active elements. In one conventional structure, the active elements may be thin film transistors (TFTs). In contrast, in passive matrix displays, thin film transistors may be unnecessary. Generally, an entire column is activated at a time and row signals are then sequentially applied to that column.

In a number of cases, individual pixels forming an array of light emitting devices may be defective. The pixels may be defective because of improper formation, contamination, or other defects. Commonly, if the defect rate is too high, the entire display may be discarded.

Thus, there is a need for ways to make displays in a more economical fashion.

DETAILED DESCRIPTION

Figure 1:
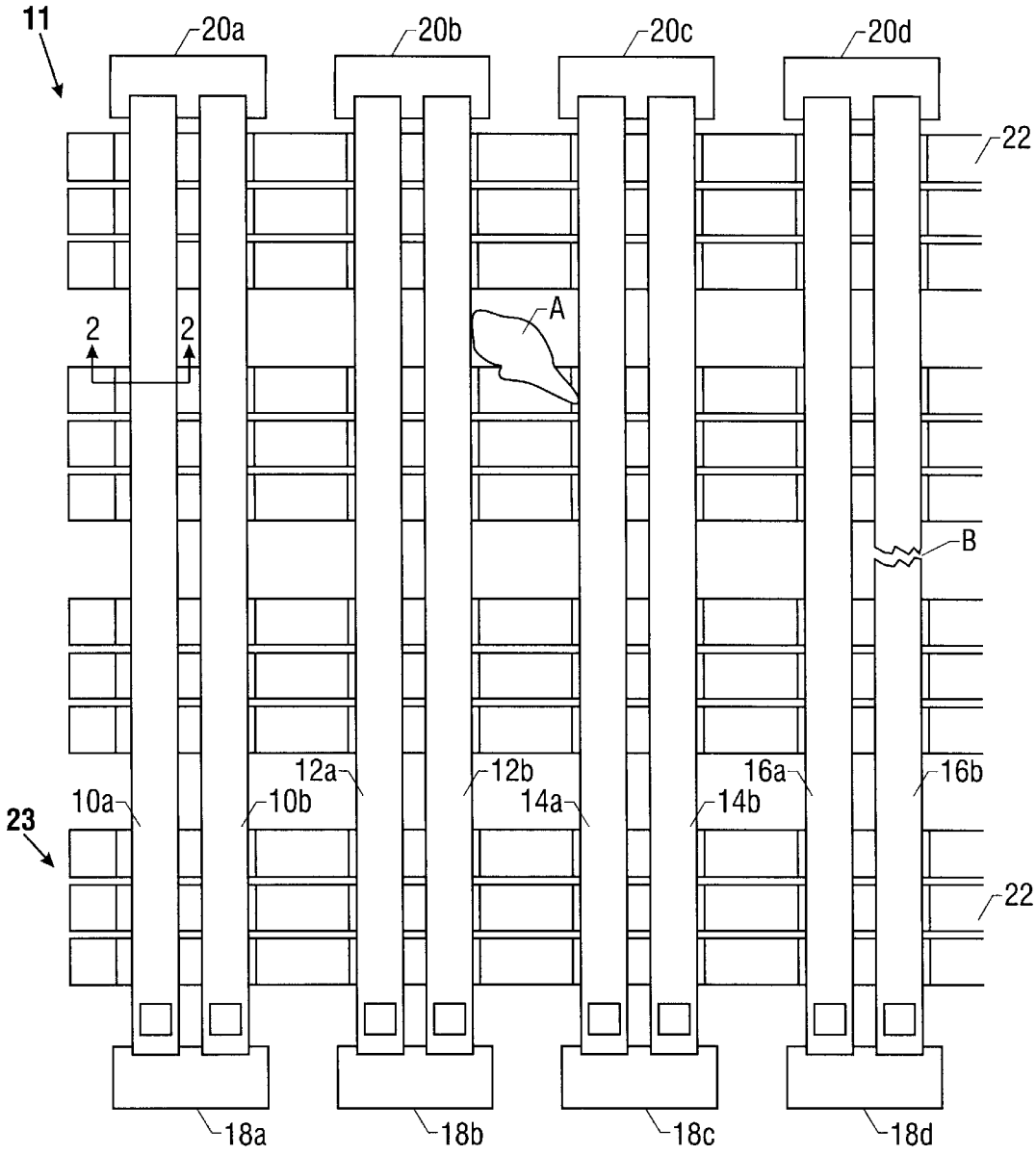
FIG. 1 is a bottom plan view of one embodiment of the present invention.

Referring to FIG. 1, the backside of a display 11 may be made up of a plurality of cathode columns 10, 12, 14 and 16 that run in a first direction and a plurality of anode rows 22 which extend generally transversely thereto. Each set 23 of three rows 22 may form a pixel that emits three different colors to form an appropriate color gamut. In the illustrated embodiment, each color is produced by a light emitting device arranged at the intersection of a column 10, 12, 14 or 16 and a row 22. In other embodiments, other layouts may be possible.

Each pixel is formed in the region where a cathode column 10, 12, 14 or 16 overlays an anode row 22. When appropriate potentials are applied between the cathode 10, 12, 14 or 16 and an anode row 22, light is emitted into the page in FIG. 1.

In one embodiment of the present invention, the cathode columns 10, 12, 14 and 16 may be formed of aluminum. The rows 22 may be formed of indium tin oxide (ITO) so that they are both conductive and substantially light transmissive.

Figure 2:
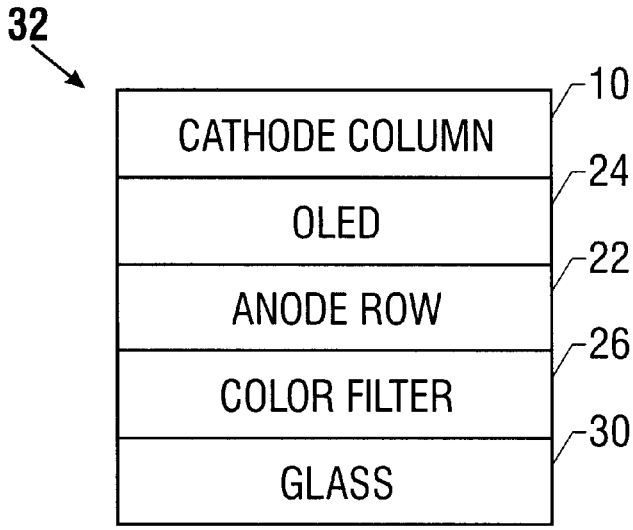
FIG. 2 is an enlarged, schematic cross-sectional view taken generally along the lines 2—2 in FIG. 1 in accordance with one embodiment of the present invention.

Referring to FIG. 2, a pixel 32 of a passive matrix light emitting device includes a cathode column 10 and an anode row 22 that sandwich a light emitting layer 24. In one embodiment of the present invention, the layer 24 may be an organic light emitting device (OLED). When appropriate potentials are applied between the cathode column 10 and anode row 22, light is emitted by the light emitting layer 24 and that light passes through the substantially transparent anode 22. That light is then filtered, in some embodiments, by a color filter 26 to produce a desired color of light. In some cases, the light emitting layer 24 may not produce the exact color which is appropriate for a particular color gamut. The emitted color may be altered by using a color filter 26 in some embodiments. Light then passes through the glass substrate 30.

Referring back to FIG. 1, each column 10, 12, 14 and 16 includes a pair of selectively coupled sections 10*a* and 10*b*, 12*a* and 12*b*, 14*a* and 14*b* and 16*a* and 16*b*. In effect, each column 10–16 has a folded architecture to form a pair of sections such as the sections 10*a* and 10*b*. Each pair of sections may be joined by a selector 20 at one end of a column 10–16 and by a multiplexer 18 on the other end. The multiplexer 18 provides a potential to one or both of the sections of a pair and the selector 20 selectively joins the pair of sections or it leaves them unjoined.

Referring to the sections 12*b* and 14*a*, a conductive particle A is causing the two sections 12*b* and 14*a* to short to one another. In such case, the column 12*b* may not be driven while the column 12*a* is driven under control of the multiplexer 18*b*. At the same time, the selector 20*b* is deselected so that a potential is only applied to the column 12*a*. Likewise, with respect to the column 14, the multiplexer 18*c* only drives the section 14*b* and the selector 20*c* does not join the sections 14*a* and 14*b*.

Conversely with respect to the column 10, there are no defects and therefore either or both sections 10*a* and 10*b* may be driven by the multiplexer 18*a*. The selector 20 joins the columns 10*a* and 10*b* to produce a folded, unitary column 10.

Finally, referring to the column 16, a column open B is present in the section 16*b*. In such case, the multiplexer 18*d* may drive only the section 16*a* and the selector 20*d* deselects the section 16*b*. Alternatively, both columns 16*a* and 16*b* may be driven but the column 16*b* may be isolated or deselected by the selector 20*d*. In this way, the section 16*b* of a folded column 16 may be deselected while the remainder of the folded column (the section 16*a*) may still be used. In some cases, additional or redundant columns or column sections may be provided to enable a display to still be useful even when a substantial number of defects are detected.

Defects may be detected in post-manufacturing examinations as one example. Once the defects are detected, rather than discarding the display 11, the multiplexers 18 and the selectors 20 may be programmed to deactivate the affected sections. The multiplexers 18 and the selectors 20 may be controlled through appropriate electrical signals provided from a controller associated with the display 11. Alternatively, the selectors 20 and multiplexers 18 may be mask programmed, for example using laser light to cut or make connections. As still another alternative, the selectors 20 and multiplexers 18 may be programmed by selectively blowing fuses. In mask programming or fuse programming embodiments, a plurality of conductive paths may be selectably programmed to either connect the sections of a given column or to prevent them from being connected and to either provide a potential to a given section or to prevent the provision of such a potential to a particular section.

Because the folded sections that form the columns 10–16 are placed relatively close together, the fact that one section does not work may not be noticeable to a user since each section is responsible for a relatively minute portion of the light produced by the overall display 11. Thus, in some embodiments, a folded architecture may enable sections which may or may not be redundant, to be selectively activated depending on the nature of defects associated with any particular section.

While the present invention has been described with respect to an embodiment using organic light emitting devices, other displays may be implemented using the techniques described herein including those that utilize liquid crystal displays (LDCs) and inorganic light emitting devices.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An organic light emitting device comprising:

a cathode column including a pair of parallel sections, each parallel section including a pair of opposed ends;

a first device to selectively couple one of the ends of each section together;

a second device to selectively drive the other of the ends of each parallel section; said second device deactivates a section associated with a defect; and a plurality of substantially transparent anode rows arranged generally transversely to said cathode column.

2. The device of claim 1 wherein one section is adapted to be selectively driven when another section is not driven.

3. The device of claim 1 including a set of three rows and an organic light emitting material between said anode rows and said cathode column such that when an appropriate potential is applied between said column and said rows, said material emits light through said anode rows.

4. The device of claim 3 wherein said device is a passive matrix display.

* * * * *